US006118439A

United States Patent [19]

Ho et al.

[11] Patent Number: 6,118,439

[45] Date of Patent: Sep. 12, 2000

[54] LOW CURRENT VOLTAGE SUPPLY CIRCUIT FOR AN LCD DRIVER

[75] Inventors: Franklin S. Ho, San Carlos; William E. Miller, Los Gatos; Ying Quan Zhong, Fremont; Richard E. Crippen, Mountain View, all of Calif.

[73] Assignee: National Semiconductor Corporation, Santa Clara, Calif.

[21] Appl. No.: 09/021,674

[22] Filed: Feb. 10, 1998

[51] Int. Cl.[7] ..... G09G 5/00

[52] U.S. Cl. ..... 345/211; 345/52

[58] Field of Search ..... 345/98, 99, 100, 345/87, 88, 89, 94, 211, 212, 213, 147, 38, 50, 51, 52, 53, 54

[56] References Cited

U.S. PATENT DOCUMENTS

| | | | |
|---|---|---|---|
| 5,521,611 | 5/1996 | Okada et al. | 345/89 |
| 5,574,475 | 11/1996 | Callahan, Jr. et al. | 345/100 |
| 5,627,457 | 5/1997 | Ishiyama et al. | 345/94 |
| 5,847,702 | 12/1998 | Jung | 345/212 |

*Primary Examiner*—Xiao Wu
*Attorney, Agent, or Firm*—Skjerven, Morrill, MacPherson, Franklin and Friel

[57] ABSTRACT

A voltage supply circuit for an LCD driver employs two voltage dividers. A low current voltage divider includes resistive elements having a high resistance, thus providing a bias voltage with a low current. A high current voltage divider includes resistive elements having low resistances, thus providing a bias voltage with a high current. The high current voltage divider provides bias voltage levels with high current at the beginning of each time phase change. Thus, the liquid crystal display receives a high current when updating the bias voltage levels on the LCD, thereby producing a fast settling time. When the bias voltage levels are held constant, however, only the low current voltage divider provides the bias voltage levels to reduce power consumption. A halt mode prevents the liquid crystal display and driver from consuming any power by disconnecting both voltage dividers from the voltage source when in sleep mode. A voltage drop mode produces a reduction in the bias voltage levels by placing another voltage drop in series with the voltage dividers.

20 Claims, 5 Drawing Sheets

LOW CURRENT VOLTAGE SUPPLY CIRCUIT FOR AN LCD DRIVER

FIELD OF THE INVENTION

The present invention relates to a voltage supply circuit, and more particularly to a low current voltage supply circuit for liquid crystal display drivers.

BACKGROUND

A liquid crystal display (LCD) has matching electrodes on front and back planes with a clear to dark changeable fluid between the two planes. As shown in FIGS. 1A and 1B, a conventional numerical LCD 10 has eight elements configured in the shape of the numeral eight followed by a dot. Specifically, LCD 10 has four vertical elements A, B, C, and D; three horizontal elements E, F, and G; and an element H in the shape of a dot. Either static drive (single back plane) or multiplex drive (partitioned back plane) method can be used to drive an LCD, as is understood by those skilled in the art. A convention ⅓ bias, ¼ duty cycle (4 back plane partitions brought out to 4 terminals) is illustrated in FIGS. 1A and 1B. One skilled in the art, however, will understand that other bias levels and duty cycles may be used by an LCD.

FIG. 1A is the front plane of LCD 10. There are two voltage supply terminal segments $S_1$A and $S_1$B on the front plane, with each segment connected to four electrodes. Voltage supply terminal segment $S_1$A is connected to electrodes A, F, C, and G and voltage supply terminal segment $S_1$B is connected to electrodes E, B, D, and H.

FIG. 1B shows the back plane partitions of LCD 10 with voltage terminals BP0, BP1, BP2, and BP3 each connected to a different pair of elements. As one skilled in the art will understand, if LCD 10 were to include additional numerical displays, i.e., additional numeral eight configurations, back plane voltage terminals BP0, BP1, BP2, and BP3 would be common to all the numerical displays.

The fluid between the front plane and back plane is darkened at a particular element when an AC voltage is applied across the electrodes connecting the element. Thus, to darken element F, for example, an AC voltage is applied across the planes at segment $S_1$A and back plane terminal BP1. A constant DC voltage applied across the planes, however, will damage LCD 10.

For LCD 10 shown in FIGS. 1A and 1B, an LCD driver 20 supplies multiplexed voltage levels at ¼ duty cycle in ⅓ voltage increments to the elements on the back plane of LCD 10 via terminals BP0, BP1, BP2, and BP3. By applying the appropriate voltage level, again in ⅓ increments, to the segments on the front plane of LCD 10 via terminals S1A and S1B, LCD driver 20 controls the display on LCD 10.

FIG. 2 is a graph showing the ¼ duty cycle, ⅓ bias voltage waveforms supplied by LCD driver 20 to LCD 10. As shown in FIG. 2, one complete scan of voltage waveforms is comprised of two frames, where one scan occurs at a desired frequency, such as 40 or 80 Hz. The first frame includes increasing voltage waveforms, while the second frame has complimentary decreasing waveforms. Thus, the voltage level across back plane terminal BP1 and segment $S_1$A, at waveform BP1/S1A, has a positive waveform in frame one and a complimentary negative waveform in frame two. Because LCD driver 20 provides voltage levels with ¼ duty cycle, there are four phases in frame 1 and four phases in frame 2, for a total of eight phases in a complete scan. Consequently, during one complete scan, there is an average AC bias voltage level with a zero average DC voltage level (integrated over all phases of the scan) across each element.

LCD driver 20 with a ¼ duty cycle changes the voltages on terminals $S_1$A, $S_1$B, BP0, BP1, BP2, and BP3 such that the elements between these terminals are at bias voltage (±⅓Vcc) for ¾ of the scan, and at either the "on" voltage (±Vcc) or at the "off" voltage (±⅓Vcc) for the remaining ¼ of the scan. Thus, as shown in FIG. 2, the junction of terminals BP1 and $S_1$A, which is element F as shown in FIGS. 1A and 1B has an "on" voltage level of +Vcc during phase 2 and a complimentary voltage level −Vcc during phase 6, and has a bias voltage level of ±⅓Vcc during the remainder of the scan.

FIG. 3 shows a conventional one-third voltage supply circuit 30 connected to a voltage source Vcc. Voltage supply circuit 30 is a voltage divider having resistors of equal resistance producing voltage levels of Vcc, ⅔Vcc, ⅓Vcc, and ground on respective output terminals Vout1, Vout2, Vout3, and Vout4. Resistive elements 40, 50, and 60 of voltage supply circuit 30 generally have equal resistances, such as approximately 1–10 kΩ (kilo ohms), although the specific resistances used may vary.

Generally, LCDs have a high resistance and capacitance between the front and back plane, e.g., approximately 1 GΩ (gigaohm) and approximately 100 pf (picofarads), respectively, for each LCD element. Because of the high capacitance between the front plane and the back plane, a large current source is required to quickly change the terminals of LCD 10 from one voltage level to another. Consequently, it is understood that although FIG. 2 shows square waveforms, in fact at each phase transition there is a settling time produced by the resistance and capacitance decay. A fast settling time, such as less than 5 μs for a 40 Hz scan, is desirable to produce an approximate square waveform, which ensures that the average D.C. voltage levels on LCD 10 over a complete scan will be zero. Because the settling time is a function of current, to produce an approximate square waveform, LCD driver 20 uses a voltage supply circuit 30 that consumes a large amount of current, typically 100 μa (microamps).

However, as shown in FIG. 2, the voltage levels on the terminals of LCD 10 change only at the transition of a phase and are held constant during the phase. Because there is a high resistance in LCD 10, maintaining the voltage levels across each element of LCD 10 during a phase requires little current. Consequently, voltage supply circuit 30 unnecessarily consumes a large amount of current during each phase resulting in large power consumption.

SUMMARY

The present invention is directed to a low current voltage supply circuit and associated method that provides high current voltage levels to an LCD driver for a short period at the beginning of each phase of a scan, and provides low current voltage levels to the LCD driver during the remainder of the phase. The low current voltage supply circuit includes a low current voltage divider and a high current voltage divider and a switching circuit to connect the high current voltage divider to the LCD driver at the appropriate times.

The high current voltage divider is connected to a voltage source and the LCD driver through a switching circuit, which is turned on and off in response to a signal indicating when LCD driver is changing any voltage levels on the LCD. In between changes, the high current voltage divider is disconnected from the voltage source and the LCD driver.

Because a large current is required only when the LCD driver changes the voltage levels on the terminals of the LCD, the voltage supply circuit provides a low current when the terminals of the LCD are held at a constant voltage level, thereby reducing power consumption. Thus, the LCD receives a large current when the voltage levels across the planes of the LCD are changed producing a fast settling time. The LCD then receives a small current from the low current voltage divider between changes of the voltage levels across the planes of the LCD to reduce power consumption.

A second embodiment includes a halt mode in which the low current voltage divider and the high current voltage divider are switchably connected to the voltage source via a switching circuit. The low current voltage divider and high current voltage divider are disconnected from the voltage source in response to a halt signal. Disconnecting the voltage dividers from the voltage source drives the voltage levels on the LCD to ground. The halt mode is employed to minimize current consumption when no data is received by the LCD driver or displayed on the LCD, for instance when the device is in "sleep" mode.

An additional embodiment employs a voltage drop mode in which the voltage dividers receive a decreased voltage from the voltage source by switchably connecting resistive elements between the voltage source and the voltage dividers in response to a voltage drop signal. The voltage drop mode advantageously permits the use of different kinds of voltage sources, such as an alkaline battery and a nickel-cadmium battery, without changing the voltage levels received by the LCD driver.

BRIEF DESCRIPTION OF THE DRAWINGS

The above and other features, aspects, and advantages of the present invention will become better understood with regard to the following description, appended claims, and accompanying figures, where:

DETAILED DESCRIPTION

Figure 4:
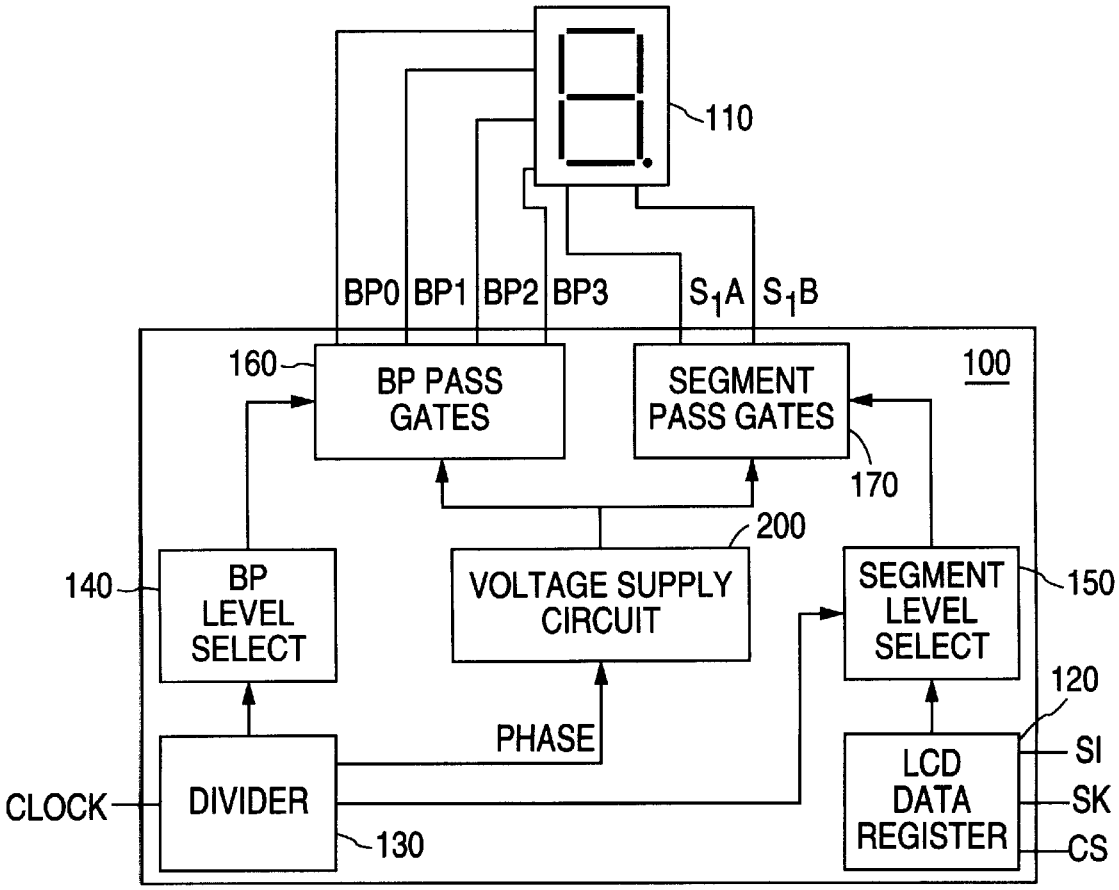
FIG. 4 is a block diagram of an LCD driver with a voltage supply circuit in accordance with the present invention.

FIG. 4 is a block diagram of an LCD driver 100 with a voltage supply circuit 200 in accordance with the present invention. LCD driver 100 includes a low current voltage supply circuit 200 that supplies a voltage level with a high current to LCD 110 only when the voltage levels on LCD 110 are changed. By way of example, and not limitation, LCD driver 100 drives a ⅓ bias, ¼ duty cycle multiplexed LCD 110 with voltage levels Vcc, ⅔Vcc, ⅓Vcc and ground.

LCD driver 100 includes a conventional LCD data register 120 that receives data signals via the serial input terminal SI. LCD data register 120 also receives a serial clock signal and a chip select signal via respective input terminals SK and CS. The serial clock and chip select signals control the serial transmission of the data signal into LCD data register 120 in a conventional manner.

LCD driver 100 also includes a divider 130 which receives a clock signal input via terminal CLOCK. The clock signal can originate either internally or externally from LCD driver 100. Divider 130 conventionally divides the clock signal to obtain the desired refresh or scan frequency. Divider 130 provides a refresh signal to back plane level select block 140 and the segment level select block 150. The refresh signal controls the phase changes and synchronizes the segment level select block 150 and back plane level select block 140. Divider 130 also produces a pulsed phase signal on terminal PHASE. The phase signal indicates the beginning of each phase of LCD 110. The duration of the pulsed signal is equivalent to the settling time for LCD 110 as will be described below. Voltage supply circuit 200 receives the phase signal from divider 130 on terminal PHASE.

Voltage supply circuit 200 provides voltage levels in one third increments to the back plane pass gates block 160 and the segment pass gates block 170. Back plane level select block 140 controls back plane pass gates block 160 and segment level select block 150 controls segment pass gates block 170. Back plane pass gates block 160 selects the required voltage levels to output terminals BP0, BP1, BP2, and BP3 connected to LCD 110, while segment pass gates block 170 selects the required voltage levels to segments $S_1A$ and $S_1B$ also connected to LCD 110. Although LCD driver 100 is shown controlling one LCD 110, it is understood that LCD driver 100 may conventionally control as many LCDs as desired. Where additional LCDs are controlled by LCD driver 100, back plane terminals BP0, BP1, BP2, and BP3 are serially connected to all the LCDs, while additional segments $S_2A$, $S_2B$, etc. (not shown) are respectively connected to each additional LCD.

Figure 2:
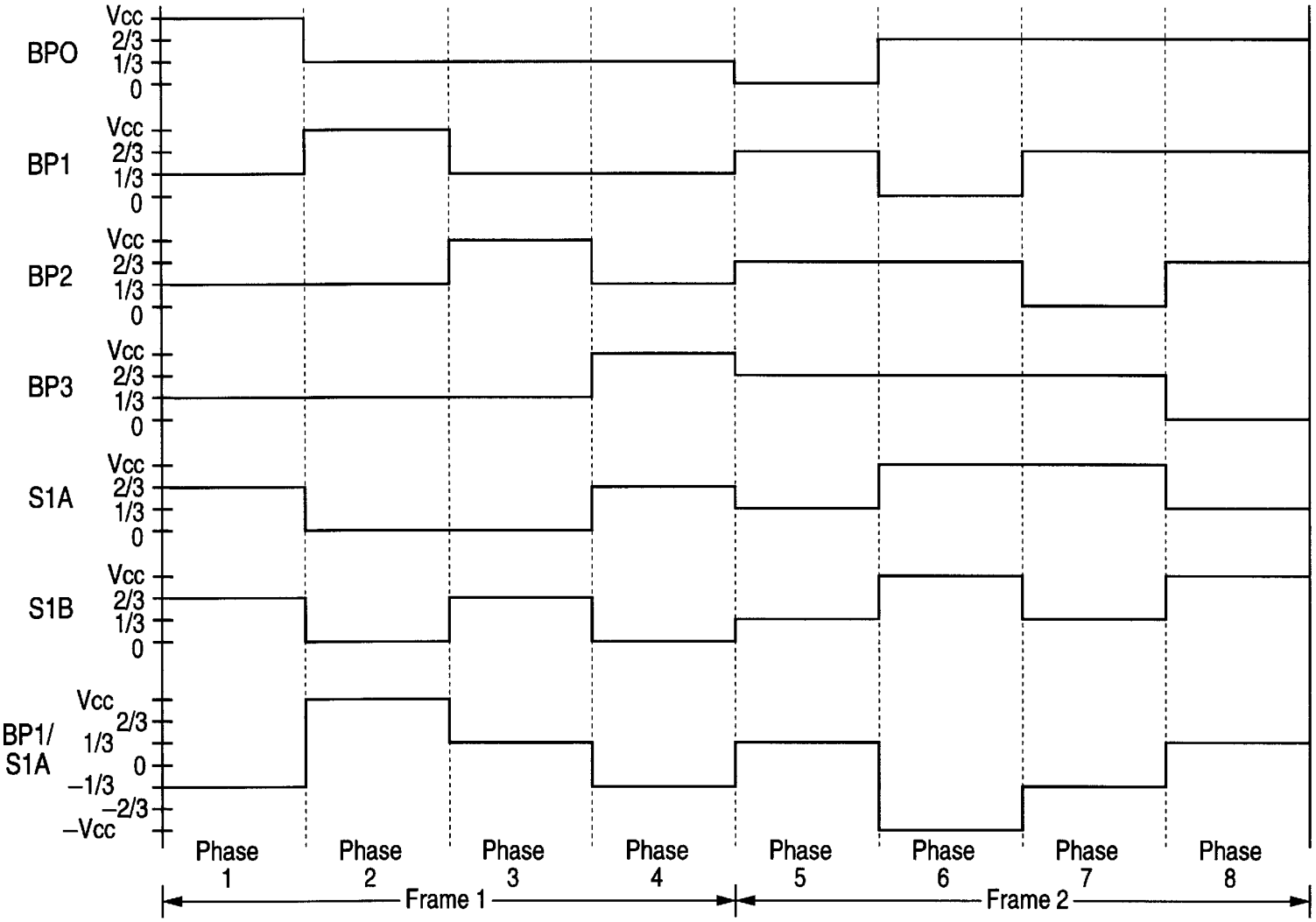
FIG. 2 shows a waveform diagram illustrating the application of ⅓ bias voltage levels on the voltage terminals BP0, BP1, BP2, BP3, $S_1A$, and $S_1B$, and the phase signal during eight time phases.
Figure 3:
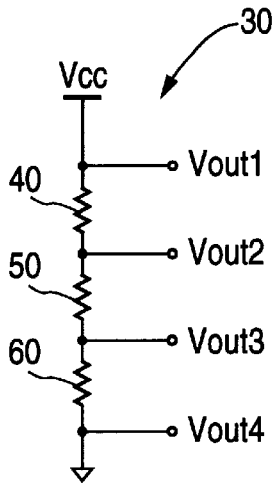
FIGURE 3 (PRIOR ART)
FIG. 3 shows a voltage supply circuit in accordance with the prior art.

LCD driver 100 conventionally multiplexes LCD 110 such that complementary positive and negative voltage levels are applied in eight time phases over one complete scan as shown in FIG. 2, for example. Of course, different multiplexing schemes may be implemented, which change the number of phases in a scan.

The waveforms produced by LCD driver 100, such as those shown in FIG. 2, are ideally square. However, because LCD 110 has a high capacitance, a non-instantaneous change exists in the voltage level across LCD 110, which prevents the waveform from being perfectly square. The change in the voltage level across LCD 110 is controlled by the relation:

$$\frac{V}{Rsource} = I = C\,dV/dt \qquad \text{equ. 1}$$

where V is the voltage level across LCD 110, Rsource is the Thevinin equivalent of the resistance in the voltage supply circuit 200, I is the current through LCD 110, C is the capacitance of the element, and dV/dt is the rate of change in the voltage level on LCD 110.

Figures 1A, 1B:
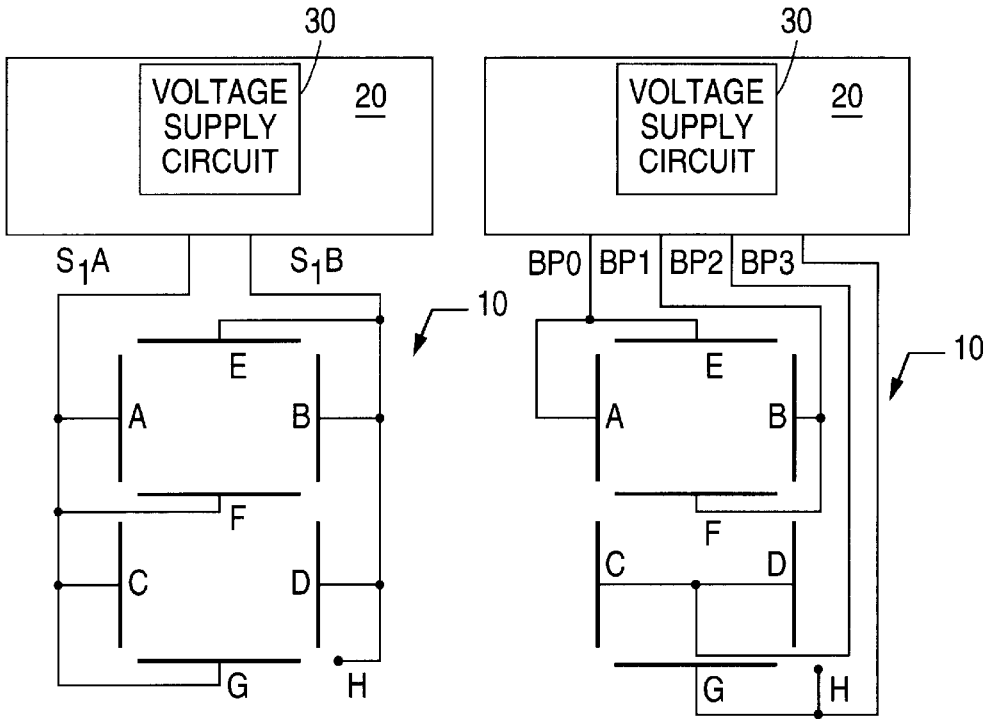
FIG. 1A shows elements A-H on the front plane of an LCD with voltage supply segments $S_1A$ and $S_1B$.
FIG. 1B shows elements A-H on the back plane of an LCD with voltage terminals BP0, BP1, BP2, and BP3.
Figure 5:
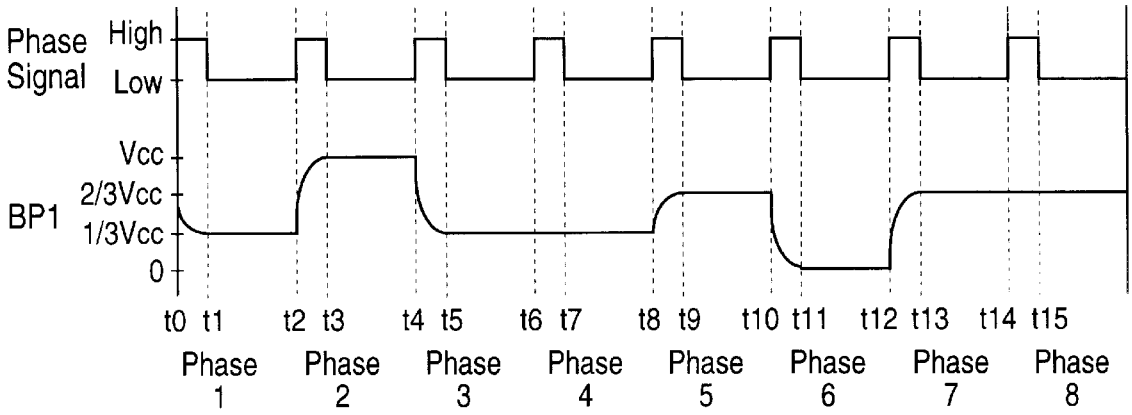
FIG. 5 is a waveform diagram illustrating the settling time of the voltage level on terminal BP1 during phase transitions.

FIG. 5 is a waveform diagram illustrating the non-instantaneous change in the voltage level at back plane terminal BP1. The pulsed phase signal provided by divider 130 indicating the beginning of each phase is also shown in FIG. 5. As shown in FIG. 5, the voltage level on BP1 transitions from ⅔Vcc to ⅓Vcc between times t0 and t1. The decay or settling time for the voltage level on BP1 is determined by the capacitance of LCD 110, which is dependent on the number of elements of LCD 110 that are being switched. The voltage level on BP1 then rises from ⅓Vcc to Vcc between times t2 and t3, with the settling time again determined by the capacitance of LCD 110.

As can be understood from equation 1, a larger current source provides a shorter settling time for the voltage level on LCD 110. Thus, in accordance with the present invention, during the beginning of each phase, such as between times t0 and t1, a high current voltage supply is provided.

However, as shown in FIG. 5, during the remainder of each phase the voltage level on BP1 is held constant. For example, during the remainder of phase 1, between times t1 and t2, the voltage level of BP1 is ⅓Vcc. Thus, during the remainder of each phase, while the voltage level is being held constant, no current is required. However, because there is a small amount of current leakage in LCD 110 caused by the approximately >1 GΩ (gigaohm) resistance in LCD 110, a small amount of current is needed to maintain the voltage level on LCD 110. As shown in FIG. 5, the majority of the scan is composed of periods where there are no changes in the voltage levels. Consequently, a small current voltage supply is provided during the remainder of each phase, which is the majority of the scan.

The phase signal determines when the high current voltage supply is turned on and turned off. As shown in FIG. 5, the phase signal is turned on at the beginning of each phase, and is turned off after enough time has passed to allow the voltage level to settle to the new voltage level. The duration of the phase signal is determined by the settling time, which is a function of the product of the Thevinin resistance of the voltage supply circuit 200 and the capacitance of LCD 110. For example, in a display where seven LCDs are driven by LCD driver 100, the worst case time constant assumes that the fourteen segments (two segments per LCD) are in the worst case phase transition and that there are three back plane terminals in parallel to ⅓Vcc, resulting in the following:

$$\text{time constant} = \text{Rsource} \times 3\text{C} \times 14\text{seg} \qquad \text{equ. 2}$$

where Rsource is the Thevinin equivalent of the resistance in the voltage supply circuit 200, C is the capacitance of an element. Because the settling time decays exponentially as an RC time constant, the phase signal turns on the high current voltage supply for a multiple of the time constant, in the above example four time constants proved adequate.

Another factor that should be considered in the determination of the duration of the phase signal are transient voltage steps or spikes that occur when there is a phase transition. As is well known in the art, a transient voltage step, which is not shown in FIG. 5, occurs because of the capacitive coupling of the terminals across an element. When there is a voltage level transition across the terminals, a transient voltage step occurs. Thus, during a phase transition, the voltage level at each terminal may be at a voltage other than a ⅓ increment of Vcc, which may result in additional settling time. Consequently, the duration of the phase signal may need to be extended to compensate for the additional settling time, which is well within the skill of those in the art.

Figure 6:
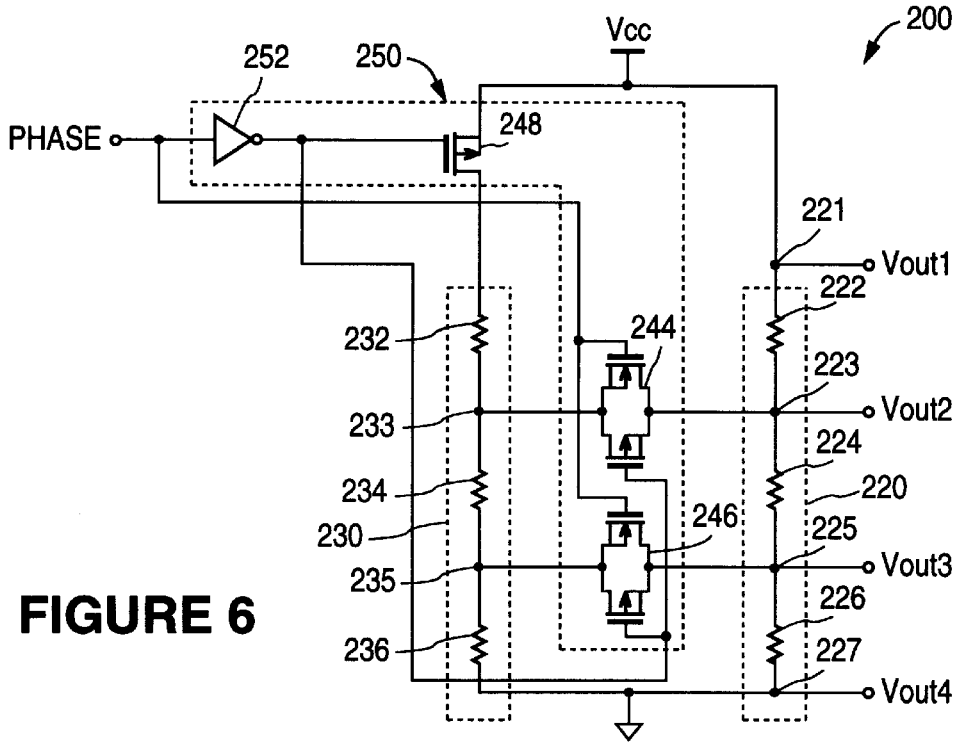
FIG. 6 is a diagram of a voltage supply circuit having two voltage dividers in accordance with the present invention.

FIG. 6 shows a voltage supply circuit 200 in accordance with the present invention. Voltage supply circuit 200 includes a voltage source Vcc, a low current voltage divider 220, and output terminals Vout1, Vout2, Vout3, and Vout4, which are connected to LCD driver 100. Voltage supply circuit 200 includes a high current voltage divider 230 that is connected to output terminals Vout1 through Vout4 via a switching circuit 250, including switches 244 and 246. As will be understood by those skilled in the art, voltage supply circuit 200 is not limited to four output terminals, but with the appropriate switching circuit 250 may have as many output terminals as desired.

Low current voltage divider 220 is shown with three resistive elements coupled together in series and disposed between voltage source Vcc and ground. Resistive elements 222, 224, and 226 of low current voltage divider 220 all have the same resistance, for example 1MΩ. The large resistance used in resistive elements 222, 224, and 226 produces a low current through voltage divider 220, which is sufficient to compensate for any current leakage in LCD 110 caused by the resistance in LCD 110. Resistive elements 222, 224, and 226 may be fabricated using various materials as is understood by those skilled in the art. Voltage source Vcc supplies a voltage between 2.5V and 5.5V. Of course, any desired voltage may be used in voltage supply circuit 200.

The four output terminals Vout1 through Vout4 are connected to low current voltage divider 220, such that voltage levels Vcc, ⅔Vcc, ⅓Vcc, and ground are applied on respective terminal Vout1, Vout2, Vout3, and Vout4. As shown in FIG. 6, output terminal Vout1 is connected to a node 221 between voltage source Vcc and resistive element 222, output terminal Vout2 is connected to a node 223 between resistive elements 222 and 224, output terminal Vout3 is connected to a node 225 between resistive elements 224 and 226, and output terminal Vout4 is connected to a node 227 between resistive element 226 and ground. It is understood by those skilled in the art that low current voltage divider 220 may produce as many voltage levels as desired by changing the number of resistive elements. Further, if desired, low current voltage divider 220 may produce voltage levels of different proportions by using resistive elements of unequal resistances, as is also well understood in the art.

High current voltage divider 230 is connected to Vcc and ground via three serial resistive elements 232, 234, and 236. Resistive elements 232, 234, and 236 all have the same resistance, for example 10KΩ, and may be fabricated using various materials, as is well understood in the art. A smaller resistance is used in resistive elements 232, 234, and 236 than is used in resistive elements 222, 224, and 226, thus a higher current is produced in voltage divider 230. The current produced by high current voltage divider should be large enough to produce the desired rate of change of the voltage levels on LCD 110.

A switching circuit 250, including switches 244 and 246, connects high current voltage divider 230 to output terminals Vout1 through Vout4. As shown in FIG. 6, switch 244 is connected between node 223 and a node 233 between resistive elements 232 and 234, while switch 246 is connected between node 225 and a node 235 between resistive elements 234 and 236. Switches 244 and 246 are parallel complementary MOSFET switches, which are well known to those skilled in the art. Switching circuit 250 also includes an inverter 252 that is used in conjunction with switches 244 and 246. The use of parallel complementary MOSFET switches permits the transmission of the output signals from high current voltage divider 230 to output terminals Vout1 through Vout4 with little resistance. Any appropriate switching device, however, may be used.

Switching circuit 250 also includes a switch 248 disposed between high current voltage divider 230 and voltage source Vcc. Switch 248 prevents current from flowing through high current voltage divider 230 when switch 248 is off. Switch 248 is shown as a P-channel MOSFET, but may be any other appropriate switching device. Inverter 252 is used in conjunction with switch 248 as well. Switch 248 may achieve the same function when located in other positions along high current voltage divider 230, such as between resistive element 236 and ground, as will be understood by those skilled in the art.

Switching circuit 250 receives the phase signal from divider 130 at the input terminal PHASE. The phase signal indicates when high current voltage divider 230 is to be connected to output terminals Vout1 through Vout4. The phase signal switches to HIGH at the beginning of each time phase and returns to LOW after an adequate settling time. When the phase signal is HIGH, the N channel MOSFETs used in switches 244 and 246 are held on, thus conducting the output signals from high current voltage divider 230 to output terminals Vout1 through Vout4. Inverter 252 inverts the HIGH phase signal to LOW, which turns on the P-channel MOSFETs used in switches 244, 246, and 248. Thus, at the beginning of each time phase, such as at time t0 in FIG. 5, switches 244, 246, and 248 are turned on, permitting current to flow through high current voltage divider 230 to output terminals Vout1 through Vout4. Thus, according to equation 1, the large current produced by high current voltage divider 230 minimizes the settling time of the voltage levels on LCD 110.

After a period of time sufficient to permit the voltage levels across LCD 110 to settle to the new voltage levels, the phase signal becomes LOW, such as at time t1 in FIG. 5. When the phase signal is LOW switches 244, 246, and 248 are turned off, which disconnects high current voltage divider 230 from voltage source Vcc and output terminals Vout1 through Vout4. Low current voltage divider 220, which remains on at all times during the duty cycle, provides the voltage levels to output terminals Vout1 through Vout4 with a small current during the remainder of the phase, such as between times t1 and t2 in FIG. 5. Because low current voltage divider 220 provides a low current voltage level through the majority of the scan, the consumption of power by LCD driver 100 is reduced.

Figure 7:
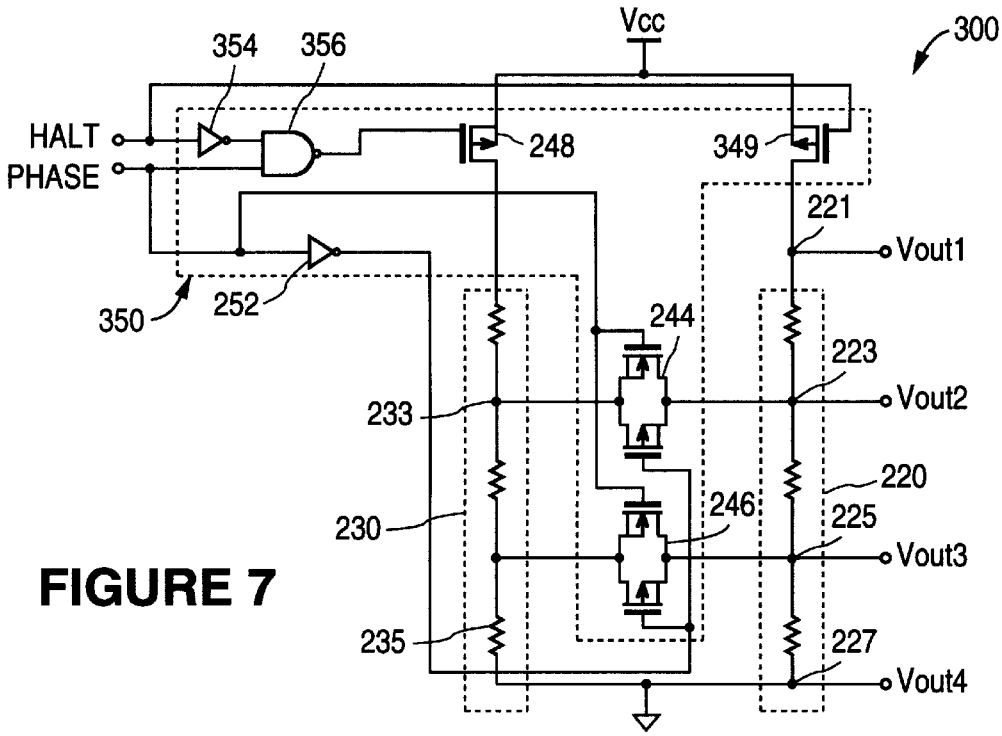
FIG. 7 is a diagram of a voltage supply circuit having two voltage dividers and employing a halt mode in accordance with another embodiment of the present invention.

FIG. 7 is a diagram of a voltage supply circuit 300 in accordance with another embodiment of the present invention. Voltage supply circuit 300 is similar to voltage supply circuit 200 of FIG. 6, like-numbered elements being the same. However, voltage supply circuit 300 employs a halt mode to minimize current consumption when no data is to be displayed by LCD 110, for instance when the device is in "sleep" mode.

Switching circuit 350 in FIG. 7 includes an additional switch 349 disposed between low current voltage divider 220 and voltage source Vcc. Switch 349 is a P-channel MOSFET, such as switch 248. It is understood, however, that other appropriate switching devices may be used. Switch 349 is used to prevent the flow of current through low current voltage divider 220 when LCD driver 110 is in halt mode. In halt mode, both switches 248 and 349 are turned off, preventing the flow of current through either low current voltage divider 220 or high current voltage divider 230 and thus driving output terminals Vout1 through Vout4 to ground.

Switches 244 and 246 are controlled in the same manner as in the embodiment of FIG. 6. However, in the halt mode embodiment switching circuit 350 includes an additional inverter 354 and a NAND logic gate 356. Switching circuit 350 receives a halt signal from LCD driver 100 on an input terminal HALT. When the halt mode is desired, the halt signal on input terminal HALT is HIGH. A HIGH halt signal is directly transmitted to switch 349 which is thereby turned off. Consequently, low current voltage divider 220 is disconnected from voltage source Vcc.

The halt signal is also transmitted to switch 248 after sequentially passing through inverter 354 and NAND logic gate 356. The input terminal PHASE is also connected to NAND logic gate 356. When the halt signal is HIGH, NAND logic gate 356 receives a LOW signal from inverter 354 and thus produces an output signal that is HIGH, regardless of the state of the phase signal. Switch 248, which is connected to the output terminal of NAND logic gate 356, is turned off and, consequently, high current voltage divider 230 is disconnected from voltage source Vcc.

When halt mode is not desired, the halt signal is LOW, which turns on switch 349. The NAND logic gate 356, however, receives a HIGH output signal from inverter 354. Thus, when the phase signal is HIGH, NAND logic gate 356 produces a LOW output signal, which turns on switch 248. Conversely, when the phase signal is LOW, NAND logic gate 356 produces a HIGH output signal, turning off switch 248. Thus, NAND logic gate 356 turns on or off switch 248 in response to the phase signal when the halt signal is LOW.

Figure 8:
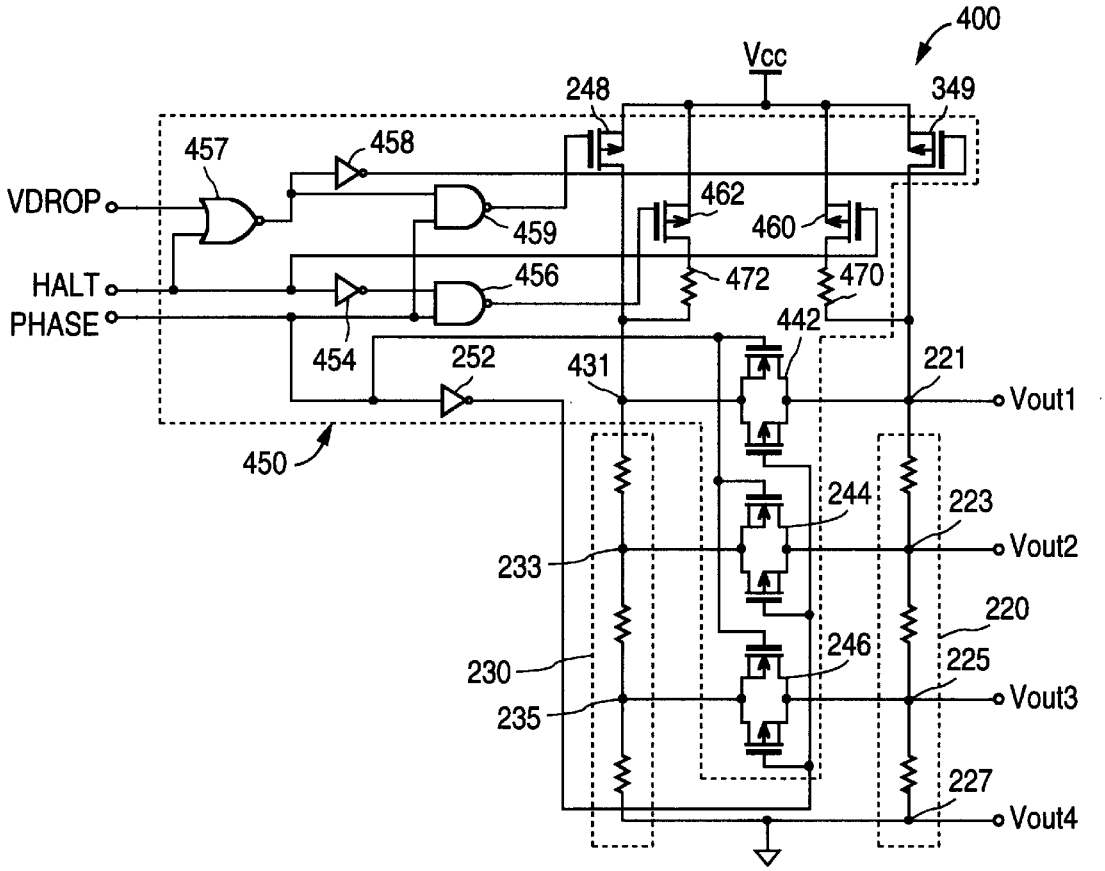
FIG. 8 is a diagram of a voltage supply circuit having two voltage dividers and employing a halt mode as well as a voltage drop mode in accordance with another embodiment of the present invention.

FIG. 8 is a diagram of a voltage supply circuit 400 in accordance with another embodiment of the present invention. Voltage supply circuit 400 is similar to voltage supply circuit 300 of FIG. 7, like-numbered elements being the same. However, voltage supply circuit 400 employs both a halt mode and a voltage drop mode. The voltage drop mode reduces the bias voltage levels produced by low current voltage divider 220 and high current voltage divider 230 by a desired percentage. Advantageously, reducing the bias voltage levels by a desired percentage permits the use of a variable voltage source. Thus, voltage source Vcc may be a voltage source such as the type used in the above embodiments, or a voltage source with a higher voltage. For instance, voltage source Vcc may use an alkaline battery, which has high energy but a low current output, or a nickel-cadmium battery, which has low energy but a high current output. When it is desired to use the higher voltage source with voltage supply circuit 400, voltage drop mode is used to reduce the bias voltage levels produced by high current voltage divider 230 and low current voltage divider 220. Thus, the higher voltage source may be used while maintaining the same voltage levels on output terminals Vout1 through Vout4. Switching between one voltage source to another is well within the skill of those in the art.

Switching circuit 450 in FIG. 8 includes additional switches 442, 460 and 462. Switch 442 is a parallel complementary MOSFET that works in the same manner as switches 244 and 246. Switch 442 is connected between node 221 and node 431, which is between high current voltage divider 230 and switch 248. Thus, switch 442 connects output terminal Vout1 to the high current voltage divider 230.

Switches 460 and 462 are P-channel MOSFETs. Switch 460 is connected to voltage source Vcc and a resistive element 470, which is connected to node 221. Switch 462 is likewise connected to voltage source Vcc and a resistive element 472, which is connected to node 231. Switches 460 and 462 and associated resistive elements 470 and 472 are in parallel with switches 349 and 248, respectively.

Switching circuit 450 includes an input terminal VDROP, which receives a voltage drop signal from LCD driver 110 to coincide with the desired decrease in voltage levels. When a decrease in the voltage is desired, the voltage drop signal is HIGH, which turns off switches 349 and 248. Thus, voltage source Vcc is connected to low current voltage divider 220 through switch 460 and resistive element 470. Resistive element 470 provides the desired decrease in voltage prior to low current voltage divider 220. Similarly, voltage source Vcc is connected to high current voltage divider 230 through switch 462 and resistive element 472. Resistive element 472 likewise provides the decreased voltage prior to high current voltage divider 230. Resistive elements 470 and 472 are chosen to provide the desired decrease in voltage. The phase signal is connected to switch 462 through NAND logic gate 456, which turns off switch 462 when the phase signal is LOW.

When no voltage drop is desired the voltage drop signal is LOW, which turns switch 349 on. Thus, low current voltage divider 220 receives the full voltage from voltage source Vcc. Switch 248 receives the phase signal via NAND logic gate 459, which turns on and off switch 248 in response to the phase signal. Consequently, high current voltage divider 230 receives the full voltage from voltage source Vcc at the appropriate times.

The halt signal is received by switches 248, 349, 460 and 462. Switch 460 receives the halt signal directly from input terminal HALT, whereas switch 462 receives the halt signal via inverter 454 and NAND logic gate 456. Switch 349 receives the halt signal via NOR logic gate 457 and inverter 458, while switch 248 receives the halt signal via NOR logic gate 457 and NAND logic gate 459.

Of course, the particular illustrated logic gates of switching circuit 450 represent the functionality of switching circuit 450 and are not limiting. Further, it is understood that voltage supply circuit 400 may be implemented without a halt mode by removing switch 460 and by appropriately modifying the logic gates of switching circuit 450, which is well within the skill of those in the art.

Although the present invention has been described in considerable detail with reference to certain versions thereof, other versions are possible. For example, some embodiments of the invention may have resistive elements with different resistances to achieve a desired proportion of bias voltage levels on the output terminals. Further, different schemes of multiplexing may result in duty cycles having different time phases. Moreover, the phase signal used to connect and disconnect the high current voltage supply to the output terminals may be generated in different manners and for different durations. Also, some components are shown directly connected to one another while others are shown connected via intermediate components. In each instance the method of interconnection establishes some desired electrical communication between two or more circuit nodes. Such communication may often be accomplished using a number of circuit configurations, as will be understood by those of ordinary skill in the art. Therefore, the spirit and scope of the appended claims should not be limited to the description of the versions depicted in the figures.

What is claimed is:

1. A voltage supply circuit, comprising:

an LCD driver;

a voltage source providing a first voltage;

a first voltage divider coupled to said voltage source to receive said first voltage, said first voltage divider coupled to said LCD driver;

a second voltage divider coupled to said voltage source to receive said first voltage; and a switching circuit comprising a switch between said second voltage divider and said LCD driver, said switching circuit receiving a phase signal from said LCD driver, said switching circuit turning on said switch in response to said phase signal.

2. The voltage supply circuit of claim 1, wherein said switching circuit further comprises a first switch coupled between said second voltage divider and said voltage source, said switching circuit turning on said first switch in response to said phase signal.

3. The voltage supply circuit of claim 1, wherein:

said first voltage divider is comprised of a first, second, and third resistive element, each of said first, second, and third resistive elements have a first resistance; and said second voltage divider is comprised of a fourth, fifth, and sixth resistive element, each of said fourth, fifth, and sixth resistive elements have a second resistance, said second resistance is less than said first resistance.

4. The voltage supply circuit of claim 3, wherein said LCD driver is coupled to each of said first, second, and third resistive elements.

5. The voltage supply circuit of claim 3, wherein said switching circuit further comprises:

a second switch coupled between said fourth resistive element and said LCD driver;

a third switch coupled between said fifth resistive element and said LCD driver; and a fourth switch coupled between said sixth resistive element and said LCD driver.

6. The voltage supply circuit of claim 5, wherein said second switch, said third switch and said fourth switch are parallel MOSFET switches.

7. The voltage supply circuit of claim 2, wherein said switching circuit further comprises:

a fifth switch coupled to said first voltage divider, said fifth switch disconnects said first voltage divider from said voltage source in response to a halt signal received by said switching circuit; and wherein said first switch disconnects said second voltage divider from said voltage source in response to said halt signal.

8. The voltage supply circuit of claim 2, further comprising:

a seventh resistive element switchably connected between said first voltage divider and said voltage source;

an eighth resistive element switchably connected between said second voltage divider and said voltage source, said eighth resistive element being in a different path than said first switch; and wherein said switching circuit is further comprised of:

a fifth switch coupled to said first voltage divider, said fifth switch disconnects said first voltage divider from said voltage source in response to a voltage drop signal received by said switching circuit;

said first switch disconnects said second voltage divider from said voltage source in response to a voltage drop signal received by said switching circuit; and a sixth switch coupled to said eighth resistive element, said sixth switch connects said voltage source to said eighth resistive element in response to said voltage drop signal and said phase signal.

9. The voltage supply circuit of claim 8, wherein said switching circuit further comprises:

a seventh switch coupled to said seventh resistive element, said seventh switch disconnecting said seventh resistive element to said voltage source in response to a halt signal received by said halt signal; and wherein:

said first switch disconnects said second voltage divider from said voltage source in response to said halt signal;

said fifth switch disconnects said first voltage divider from said voltage source in response to said halt signal; and said sixth disconnects said eighth resistive element from said voltage source in response to said halt signal.

10. A method comprising:

providing a power supply voltage to a first voltage divider, said first voltage divider providing at least one voltage having a first current to an LCD driver; and switchably providing said power supply voltage to a second voltage divider and switchably connecting said second voltage divider to said LCD driver in response to a signal indicating when LCD driver is changing voltage levels in an LCD, said second voltage divider providing approximately said at least one voltage having a second current to said LCD driver.

11. The method of claim 10, wherein said second current is greater than said first current.

12. The method of claim 10, wherein said first voltage divider provides three voltages to said LCD driver, and said second voltage divider provides approximately the same three voltages to said LCD driver.

13. The method of claim 10, further comprising switchably disconnecting said power supply voltage from both said first voltage divider and said second voltage divider in response to a signal indicating when power conservation is desired.

14. The method of claim 10, further comprising switchably connecting a first resistive element to said first voltage divider and switchably connecting a second resistive element to said second voltage divider in response to a signal indicating when a voltage drop is desired, said first voltage divider and second voltage divider providing a second at least one voltage to said LCD driver, wherein said at least one voltage is greater than said second at least one voltage.

15. A voltage supply circuit comprising:

a voltage source;

a low current voltage divider coupled to said voltage source and coupled to an LCD driver;

a high current voltage divider switchably coupled to said voltage source and switchably coupled to said LCD driver; and a switching circuit switchably coupling said high current voltage divider to said voltage source and to said LCD driver in response to a signal indicating when said LCD driver is changing voltage levels in an LCD.

16. The voltage supply circuit of claim 15, wherein said low current voltage divider provides at least one voltage to said LCD driver and said high current voltage divider provides approximately said at least one voltage to said LCD driver when said high current voltage divider is switchably coupled to said voltage source and to LCD driver.

17. The voltage supply circuit of claim 16, wherein said at least one voltage comprises three voltages.

18. The voltage supply circuit of claim 15, wherein:

said low current voltage divider is switchably coupled to said voltage source; and said switching circuit switchably decouples said low current voltage divider and said high current voltage divider from said voltage source in response to a signal indicating when power conservation is desired.

19. The voltage supply circuit of claim 15, further comprising:

a first resistive element switchably coupled to said voltage source and said low current voltage divider; and a second resistive element switchably coupled to said voltage source and said high current voltage divider;

wherein:

said low current voltage divider is switchably coupled to said voltage source;

said switching circuit switchably decouples said low current voltage divider and said high current voltage divider from said voltage source in response to a signal indicating when a decrease in said at least one voltage is desired; and said switching circuit switchably couples said first resistive element between said voltage source and said low current voltage divider, and said second resistive element between said voltage source and said high current voltage divider in response to said signal indicating when a decrease in said at least one voltage is desired.

20. The voltage supply circuit of claim 19, wherein said switching circuit switchably couples said second resistive element between said voltage source and said high current voltage divider in response to said signal indicating when said LCD driver is changing voltage levels in said LCD.

* * * * *